United States Patent [19]

MacDonald

[11] 4,051,689

[45] Oct. 4, 1977

[54] AIR SEPARATING APPARATUS

[76] Inventor: Ronald A. MacDonald, 904-510 W. Hastings, Vancouver, B. C., Canada, V6B 1L8

[21] Appl. No.: 693,974

[22] Filed: June 8, 1976

[51] Int. Cl.[2] ..... F25B 9/02

[52] U.S. Cl. ..... 62/5

[58] Field of Search ..... 62/5

[56] References Cited

U.S. PATENT DOCUMENTS

| | | | |
|---|---|---|---|
| 1,952,281 | 3/1934 | Ranque | 62/5 |
| 2,519,028 | 8/1950 | Dodge | 62/5 |
| 2,731,811 | 1/1956 | Levitt | 62/5 |
| 3,160,490 | 12/1964 | Fabre et al. | 62/5 |
| 3,197,969 | 8/1965 | Over | 62/5 |

*Primary Examiner*—Lloyd L. King

*Attorney, Agent, or Firm*—Larson, Taylor and Hinds

[57] ABSTRACT

A separator intended for use in dividing air into relatively warm and cool components is provided with an elongated cylindrical housing having one open end. The housing encloses a rotatably mounted and motor driven impeller having a portion near the open end for moving air axially and a portion near the opposite end of the housing for moving air radially thereof. The opposite end of the housing has means which carries away warm air from an area near the longitudinal axis of the impeller while other means radially spaced from the axis carries away relatively cool air.

1 Claim, 3 Drawing Figures

AIR SEPARATING APPARATUS

My invention relates to improvements in air separators.

Known separators for gases and the like have design limitations which render them unsuitable for use as part of a simplified air-conditioning system. The present invention, on the other hand, does provide extremely economical means for controlling the temperature of a room or other areas. For example, the apparatus can be mounted on a window ledge to draw in outside air. That air is divided by the apparatus into two parts according to the temperature with the warm part being returned outside and the cool part discharged into the room.

In order to achieve these results, a device according to the present invention may be defined as air separating apparatus which comprises a housing having an intake end and a discharge end, an impeller rotatably mounted within the housing and having a axial flow portion and a radial flow portion near the intake and discharge ends respectively, said discharge end having first and second port means radially spaced apart with respect to a longitudinal axis of the housing, duct means separately connected to the first and second port means respectively for conducting warm and cool air components away from the housing, and drive means for rotating the impeller.

In drawings which illustrate a preferred embodiment of the invention:

Figure 1:
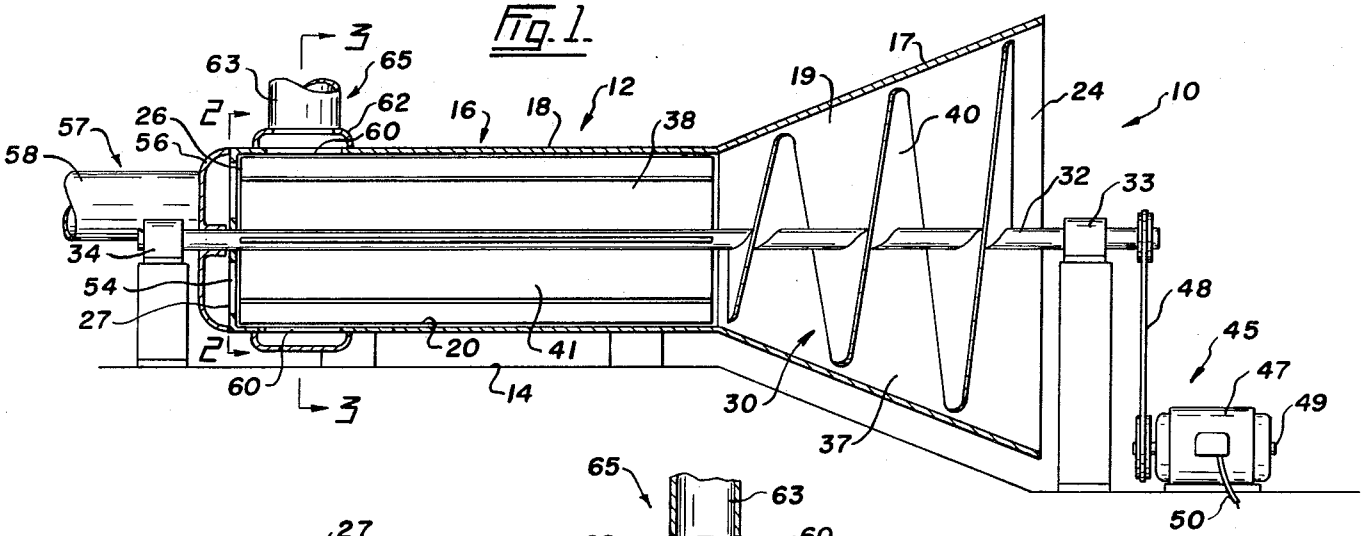
FIG. 1 is a longitudinal section of air separating apparatus constructed in accordance with the present invention.

Referring to the drawings, the numeral 10 indicates generally air separating apparatus which includes a housing 12. The housing generally indicated at 12 is shown suitably supported on a base 14 so as to be firmly held against rotational as well as other movement.

Housing 12 has a peripheral wall 16 which is shaped to provide the housing with a tapered section 17 and a cylindrical section 18. Within the housing 12, there are correspondingly shaped chambers 19 and 20. The section 17 has an open or intake end 24 which allows ambient air to be propelled through the chamber 19 into the chamber 20. The cylindrical section 18 of the housing has a discharge end 26 formed in part by an end wall 27 and an adjoining part of the peripheral wall 16 of the housing.

The air separating apparatus 10 is provided with an impeller generally indicated at 30. This impeller 30 comprises a shaft 32 which extends longitudinally through the center of the housing, the opposite ends of the shaft being shown suitably journalled in bearings 33 and 34 carried by the base 14. The impeller 30 has a portion 37 adapted to move air axially through the housing and also a portion 38 adapted to propel the same air radially of the chamber 20 or towards the peripheral wall 16. The axial flow portion 37 is a feed worm 40 which tapers inwardly from the intake end 24 towards the longitudinal axis of the shaft 32. Radial flow portion 38 of the impeller has a suitable number of blades 41 which extends radially from a hub 42 fixedly secured to the shaft 32, see particularly FIG. 3.

The present apparatus is provided with means generally indicated at 45 for rotating the impeller 30. As shown in FIG. 1, the drive means 45 comprises an electric motor 47 which is mounted on the base 14 near the intake end 24 of the housing. A belt and pulley arrangement 48 operatively connects drive shaft 49 of the electric motor to the adjacent end of the impeller shaft 32. Motor 47 is connected by a circuit 50 which includes a control switch, not shown, to a source of electric potential.

Figure 2:
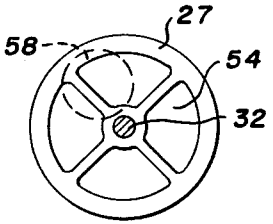
FIG. 2 is a transverse section taken on the line 2—2 of FIG. 1 showing duct means for the apparatus and ports which discharge into such means.

It will be apparent the above described structure is intended to move air surrounding the intake end of the housing through the chambers 19 and 20 from right to left as viewed in FIG. 1. The prepelled air escapes from the left or discharge end 26 of the housing and therefore the end wall 27 is provided with pots 54. These large-capacity ports 54 appear in FIG. 1 but in FIG. 2 they will be seen to be located close to the shaft 32. The ports 54 are, in fact, circumferentially and closely spaced apart on an imaginary circle concentric with the shaft 32.

Air discharged through the ports 54 is received by an annular manifold 56 which is secured to the outer face of the end wall 27 to enclose the projecting end of the propeller shaft 32. The manifold 56 forms part of duct means generally indicated at 57 and including a large-capacity pipe 58 which extends to a room or other space requiring a supply of warm air.

Figure 3:
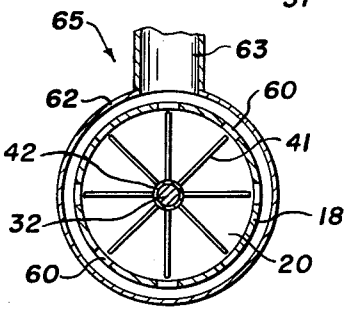
FIG. 3 is a similar vertical section taken on the line 3—3 of FIG. 2 showing other duct means of the apparatus with an associated port arrangement.

Near the end wall 27, the peripheral wall 16 is provided with ports 60 which can be seen in FIGS. 1 and 3. The ports 60, which are also capable of handling large amounts of air, are circumferentially spaced around the peripheral wall of the housing to discharge into a manifold 62 fitted with a large-capacity pipe 63. The manifold 62 and pipe 63 combine to provide duct means generally indicated at 65 for conveying cool air to a space where such air is required.

In operation, the impeller 30 is driven at a high rate of speed by the motor 47. Surrounding air is drawn into the intake end 24 of the housing and is propelled by the tapered feed worm 40 through the chamber 19 into the chamber 20. The radial flow portion 38 of the impeller acts as a centrifuge to separate the air within the chamber 20 approximately into two components. A relatively cool component, being slightly heavier, is propelled towards the peripheral wall 16 and is carried away through the ports 60 and duct means 65 to a area requiring somewhat cooler air than that which surrounds the apparatus. The relatively warm component of air is propelled partly by the action of the axial flow portion 37 of the impeller towards the end wall 27 and this air escapes through the ports 54 into the duct means 57 which carries that air to its destinaton.

From the foregoing, it will be apparent I have provided a simply constructed apparatus which is quite effective as an air separator where wide temperature differentials are not involved.

What I claim is:

1. Apparatus for separating air into relatively warm and cool components comprising a housing having a tapered section and a cylindrical section, said tapered section tapering outwardly from the cylindrical section and having an open intake end, said cylindrical section having a discharge end remote from the tapered section, an impeller rotatably mounted within the housing and having an axial flow portion and a radial flow portion, said axial flow portion being a feed worm tapered to conform to the tapered section, said radial flow portion having a plurality of radial blades extending into close proximity with an inner periphery of the cylindrical section, said discharge end having first and second port means radially spaced apart with respect to a longitudinal axis of the housing, said first port means being positioned to discharge axially moving air, said second port means being positioned to discharge radially moving air, duct means separately connected to the first and second port means respectively for conducting warm and cool air components away from the housing, and drive means for rotating the impeller.

* * * * *